US010260131B2

(12) United States Patent
Liu et al.

(10) Patent No.: US 10,260,131 B2
(45) Date of Patent: Apr. 16, 2019

(54) FORMING HIGH-STRENGTH, LIGHTWEIGHT ALLOYS

(71) Applicant: GM GLOBAL TECHNOLOGY OPERATIONS LLC, Detroit, MI (US)

(72) Inventors: Zhongyi Liu, Troy, MI (US); Frederick E. Pinkerton, Macomb Township, MI (US); Tengjiao Qi, Clinton Township, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 154 days.

(21) Appl. No.: 15/232,487

(22) Filed: Aug. 9, 2016

(65) Prior Publication Data

US 2018/0044765 A1 Feb. 15, 2018

(51) Int. Cl.

| | |
|---|---|
| ***C22C 30/00*** | (2006.01) |
| ***C22C 1/04*** | (2006.01) |
| ***B22F 9/04*** | (2006.01) |

(52) U.S. Cl.

CPC ..... *C22C 30/00* (2013.01); *B22F 9/04* (2013.01); *C22C 1/04* (2013.01); *C22C 1/0416* (2013.01); *C22C 1/0491* (2013.01); *B22F 2009/041* (2013.01); *B22F 2009/042* (2013.01); *B22F 2009/043* (2013.01)

(58) Field of Classification Search

CPC ..... C22C 21/00; C22C 1/0416

See application file for complete search history.

(56) References Cited

U.S. PATENT DOCUMENTS

| | | | |
|---|---|---|---|
| 4,710,246 | A | 12/1987 | Le Caer et al. |
| 4,729,790 | A | 3/1988 | Skinner |
| 4,731,133 | A | 3/1988 | Dermarkar |
| 4,743,317 | A | 5/1988 | Skinner et al. |
| 4,878,967 | A | 11/1989 | Adam et al. |
| 4,879,095 | A | 11/1989 | Adam et al. |
| 5,053,085 | A | 10/1991 | Masumoto et al. |
| 5,152,829 | A | 10/1992 | Skinner et al. |
| 5,284,532 | A | 2/1994 | Skinner |
| 5,312,494 | A | 5/1994 | Horimura et al. |
| 5,344,507 | A | 9/1994 | Masumoto et al. |
| 5,405,462 | A | 4/1995 | Masumoto et al. |
| 5,415,709 | A | 5/1995 | Kita |
| 5,509,978 | A | 4/1996 | Masumoto et al. |
| 5,522,948 | A | 6/1996 | Sawa et al. |
| 5,578,144 | A | 11/1996 | Satou et al. |
| 5,714,018 | A | 2/1998 | Kita et al. |
| 6,712,915 | B2 | 3/2004 | Symko et al. |
| 7,380,583 | B2 | 6/2008 | Gallerneault et al. |
| 7,465,333 | B1 | 12/2008 | Halalay et al. |
| 7,919,174 | B2 | 4/2011 | Ruokolainen et al. |
| 8,052,224 | B2 | 11/2011 | Luo et al. |
| 8,328,971 | B2 | 12/2012 | Kia et al. |
| 2009/0183996 | A1 | 7/2009 | Richter et al. |
| 2009/0226755 | A1 | 9/2009 | Sigler et al. |
| 2010/0092790 | A1 | 4/2010 | Luo et al. |
| 2010/0290942 | A1 | 11/2010 | Becker et al. |
| 2013/0121869 | A1 | 5/2013 | Kulkarni et al. |
| 2014/0227553 | A1 | 8/2014 | Im et al. |
| 2015/0167130 | A1 | 6/2015 | Steinwandel et al. |
| 2017/0136697 | A1 | 5/2017 | Kia et al. |
| 2017/0136698 | A1 | 5/2017 | Kia et al. |
| 2017/0211168 | A1 | 7/2017 | Liu et al. |
| 2018/0044765 | A1 | 2/2018 | Liu et al. |
| 2018/0216501 | A1 | 8/2018 | Brown et al. |
| 2018/0216658 | A1 | 8/2018 | Brown et al. |
| 2018/0237890 | A1 | 8/2018 | Liu et al. |

FOREIGN PATENT DOCUMENTS

| | | | |
|---|---|---|---|
| CN | 1886213 | A | 12/2006 |
| CN | 101443482 | A | 5/2009 |
| CN | 103642991 | A | 3/2014 |
| CN | 103842527 | A | 6/2014 |
| CN | 107008902 | A | 8/2017 |
| DE | 102017200968 | A1 | 7/2017 |
| JP | H0252683 | B2 | 11/1990 |

OTHER PUBLICATIONS

Seong Woo Kim et al.; "Removal of primary iron rich phase from aluminum-silicon melt by centrifugal separation"; Overseas Foundry, vol. 10, No. 2; Mar. 2013; pp. 112-117.

First Office Action for Chinese Patent Application No. 201710061115.5 dated Jun. 1, 2018 with English language machine translation, 9 pages.

*Primary Examiner* — C Melissa Koslow

(74) *Attorney, Agent, or Firm* — Harness, Dickey & Pierce, P.L.C.

(57) ABSTRACT

In an example of a method for forming a high-strength, lightweight alloy, starting materials are provided. The starting materials include aluminum, iron, and silicon. The starting materials are ball milled to generate the high-strength, lightweight alloy of a stable $Al_xFe_ySi_z$ phase, wherein x ranges from about 3 to about 5, y ranges from about 1.5 to about 2.2, and z is about 1.

20 Claims, 3 Drawing Sheets

FORMING HIGH-STRENGTH, LIGHTWEIGHT ALLOYS

TECHNICAL FIELD

The present disclosure relates generally to forming high-strength, lightweight alloys.

BACKGROUND

Steel and titanium alloys have been used in the manufacturing of vehicles. These alloys provide high temperature strength, but they can be heavy and/or expensive. Components made of lightweight metals have been investigated in vehicle manufacturing, where continual improvement in performance and fuel economy is desirable. Some examples of lightweight metals include aluminum and/or magnesium alloys. However, industry standards and limitations during the formation process may dictate which alloy materials and alloying constituents are selected. Alloy selection may ultimately be tailored to the microstructural properties that are desirable for the component being formed and based on what can be achieved during the formation process conditions.

SUMMARY

In an example of a method for forming a high-strength, lightweight alloy, starting materials, including aluminum, iron, and silicon, are provided. The starting materials are ball milled to generate the high-strength, lightweight alloy of a stable $Al_xFe_ySi_z$ phase, wherein x ranges from about 3 to about 5, y ranges from about 1.5 to about 2.2, and z is about 1.

BRIEF DESCRIPTION OF THE DRAWINGS

Features of examples of the present disclosure will become apparent by reference to the following detailed description and drawings.

DETAILED DESCRIPTION

Figure 1A:
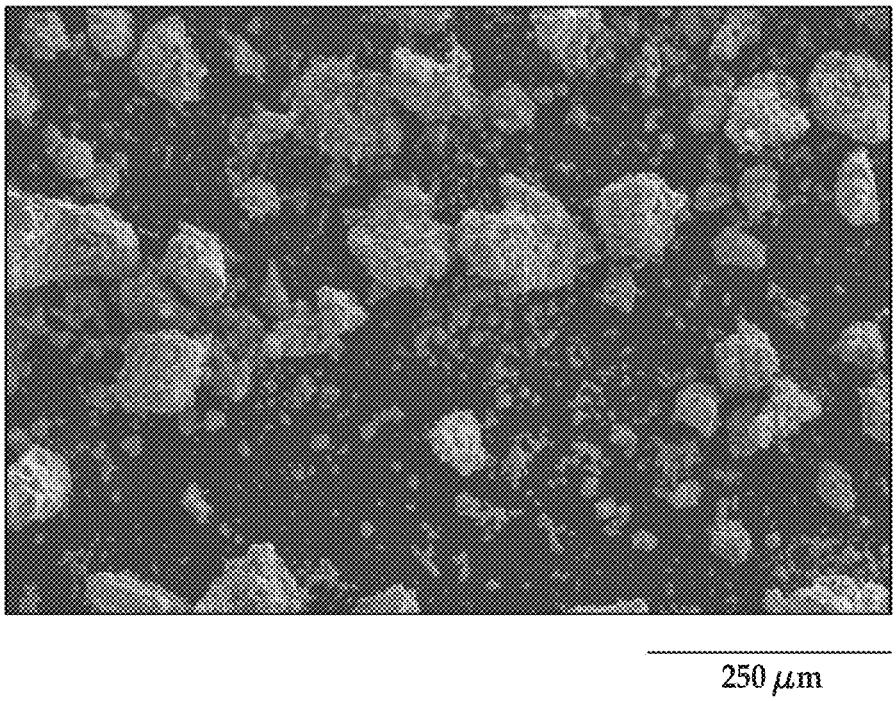
FIGS. 1A and 1B are, respectively, Scanning Electron Microscope (SEM) images of a 1 gram sample of $Al_4Fe_{1.7}Si$ and a 3 gram sample of $Al_4Fe_{1.7}Si$ formed via examples of the method disclosed herein.

Aluminum, iron, and silicon are relatively abundant materials. Theoretically, iron aluminides (e.g., quasi-equilibrium cubic $Al_xFe_ySi_z$ ternary phases) have extreme properties at densities approaching titanium (e.g., less than 5 g/cm$^3$), but with costs that are an order of magnitude less than titanium. For example, cubic $Al_xFe_ySi_z$ phases have exceptional stiffness, high temperature strength, ductility (e.g., at least 5 slip systems in the crystal structure, where there are 12 slip systems in face centered cubic (FCC) structures and up to 48 slip systems in body-centered cubic (BCC) systems), and tensile strength at room temperature (e.g., greater than or equal to 450 MPa). These phases also have high oxidation resistance due to the presence of large amounts of aluminum.

One stabilized high-symmetry lightweight phase of interest is $\tau_{10}$ or $\tau_{11}$, which refer to the same phase with the formula $Al_xFe_ySi_z$, where x ranges from about 4 to about 5, y ranges from about 1.5 to about 2.2, and z is about 1. The $\tau_{10}$ or $\tau_{11}$ phase can be represented by a formula of $Al_4Fe_{1.7}Si$ or $Al_5Fe_2Si$, which are generally interchangeable to reflect the compositional range of the phase. Crystallographic data for these phases has lattice parameters of a=0.7509 nm and c=0.7594 nm (the a/c ratio is almost 1, indicating that the structure is close to a distorted FCC phase). A space group for these phases is P63/mmc and the Pearson symbol is hP28. A structure type of the stable $\tau_{10}$ or $\tau_{11}$ phase is a $Co_2Al_5$ type or a distorted FCC. The density of these phases is about 4.1 g/cm$^3$. Another stabilized lightweight phase of interest is $\tau_{12}$, which has the formula $Al_3Fe_2Si$. Crystallographic data for this phase has lattice parameters of a=b=c=1.0806 nm. A space group for this phase is Fd-3m. A structure type of this phase is a $NiTi_2$ type, and the Pearson symbol for this type is cF96.

The formation of such stable $Al_xFe_ySi_z$ phases in the iron-aluminum-silicon materials systems can be challenging, in part because the iron-aluminum-silicon material system has at least 11 ternary phases (a select few of which are cubic and stable at high temperatures) and because the stable cubic phases occur within a narrow processing window. For example, the $Al_4Fe_{1.7}Si$ phase is a high temperature phase which is stable between 727° C. and 997° C. Stabilization of the $Al_4Fe_{1.7}Si$ phase at room temperature requires rapid solidification of the melt. The available cooling rates are about $10^2$ K/s and about $10^5$ K/s achieved by water-cooled crucible solidification and melt-spinning, respectively. At these cooling rates, the material formed generally does not have the desirable $Al_4Fe_{1.7}Si$ phase as the predominant phase. Moreover, the composition range of the $Al_4Fe_{1.7}Si$ phase is small (at. %): Al (66-64.5), Fe (~24.5), Si (9.5-11) and a small fluctuation in composition will change the solidification path, creating an unwanted microstructure.

The method(s) disclosed herein utilize a solid-state reaction to generate stabilized lightweight ternary phases of interest in the aluminum-iron-silicon system. In particular, the method(s) may be used to generate alloys of the stable $Al_xFe_ySi_z$ phase, wherein x ranges from about 3 to about 5, y ranges from about 1.5 to about 2.2, and z is about 1.

The solid-state reaction is a relatively low temperature process (e.g., from about 100° C. to about 120° C.), especially in comparison to processes that melt the starting or precursor materials at temperatures at or above 1250° C. (the melting point of stoichiometric compositions of Al, Fe and Si within the desired composition range). The low temperature process disclosed herein utilizes starting materials in solid form, and thus eliminates the high temperature solidification process from the molten state during which other phases can form.

To perform the solid-state reaction, ball milling is utilized. Ball milling strikes the starting materials together energetically between rapidly moving milling media (e.g., milling balls), or between a milling medium and the wall of the milling vessel, in order to achieve atomic mixing and/or mechanical alloying.

An example of the method involves providing aluminum, iron, and silicon starting materials. Each of the starting materials may be in powder form. For example, elemental aluminum powder, elemental iron powder, and elemental silicon powder may be used. The aluminum powder may be at least 99% pure aluminum. An example aluminum powder, which is 99.5% aluminum, is available from Alfa Aesar. The iron powder may be at least 97% pure iron. An example iron powder, which is 97% iron, is available from J.T. Baker. The silicon powder may be at least 99% pure silicon. An example silicon powder, which is 99.5% silicon, is available from Alfa Aesar. Since the starting materials are substantially pure, the resulting phases have trace amounts (e.g., ≤4.5%) of other alloying elements.

When it is desirable to form the $Al_xFe_ySi_z$ phase, where x ranges from about 4 to about 5, y ranges from about 1.5 to about 2.2, and z is about 1, the starting materials may include from about 41 wt % to about 55 wt % aluminum based on the total wt % of the starting materials, from about 33 wt % to about 48 wt % iron based on the total wt % of the starting materials, and from about 9 wt % to about 13 wt % silicon based on the total wt % of the starting materials.

When it is desirable to form the $Al_xFe_ySi_z$ phase, where x is equal to 3, y is equal to 2, and z is equal to 1, the starting materials may include from about 36 wt % to about 37 wt % aluminum based on the total wt % of the starting materials, from about 50 wt % to about 51 wt % iron based on the total wt % of the starting materials, and from about 12 wt % to about 13 wt % silicon based on the total wt % of the starting materials.

The powders may separately be added to the ball mill, or may be combined together, and then the combined powder may be added to the ball mill.

Ball milling may be accomplished using any suitable high energy ball milling apparatus. Examples of high energy ball milling apparatuses include conventional ball mills (which move the entire drum, tank, jar, or other milling vessel containing the milling media and the starting materials in a rotary or oscillatory motion) and attritors (which stir the milling media and starting materials in a stationary tank with a shaft and attached arms or discs). An example of a conventional ball mill includes the SPEX SamplePrep 8000M MIXER/MILL®. The drum, tank, jar, or other milling vessel of the ball milling apparatus may be formed of stainless steel, hardened steel, tungsten carbide, alumina ceramic, zirconia ceramic, silicon nitride, agate, or another suitably hard material. In an example, the ball mill drum, tank, jar, or other milling vessel may be formed of a material that the aluminum starting material will not stick to.

Ball milling may be accomplished with any suitable milling or grinding media, such as milling balls. The milling media may be stainless steel balls, hardened steel balls, tungsten carbide balls, alumina ceramic balls, zirconia ceramic balls, silicon nitride balls, agate balls, or another suitably hard milling medium. The milling media may include at least one small ball (having a diameter ranging from about 3 mm to about 7 mm) and at least one large ball (having a diameter ranging from about 10 mm to about 13 mm). In an example, the ratio of large balls to small balls is 1:2. As one example, the grinding media includes two small balls, each of which has a diameter of about 6.2 mm, and one large ball having a diameter of about 12.6 mm. The number of large and small balls, as well as the size of the balls, may be adjusted as desired.

The milling media may be added to the ball mill drum, tank, jar, or other milling vessel before or after the starting materials are added.

Ball milling may be accomplished in an environment containing a non-reactive gas. In an example, the non-reactive gas is an inert gas, such as argon gas, helium gas, or neon gas. Another suitable non-reactive gas may be nitrogen ($N_2$) gas. Air, oxygen gas, etc. may not be suitable due to the fact that these gases can readily form oxides on the surface of the starting materials.

Ball milling may be performed at a speed and for a time that are sufficient to generate the desirable $Al_xFe_ySi_z$ phase. In an example, the speed of ball milling may be about 1060 cycles/minute (115 V mill) or 875 cycles/minute (230 V mill). In an example, the time for which ball milling may be performed ranges from about 8 hours to about 32 hours. The time may vary depending upon the amount of starting materials used and the amount of the phase that is to be formed. As one example, ball milling may be performed for about 16 hours to form 1 gram of the $Al_4Fe_{1.7}Si$ or $Al_5Fe_2Si$ phase. As another example, ball milling may be performed for 32 hours to form 3 grams of the $Al_4Fe_{1.7}Si$ or $Al_5Fe_2Si$ phase.

In some examples of the method disclosed herein, a liquid medium may be added to the ball mill with the grinding media and the starting materials. In this example, the starting materials are ball milled in the presence of the grinding media as well as the liquid medium. The liquid medium may be added to prevent malleable metal (e.g., aluminum) from becoming permanently pressed against, or adhered/stuck to, the walls of the ball mill drum, tank, jar, or other milling vessel. Any liquid medium that will not oxidize the metal starting materials may be used. In an example, an anhydrous liquid medium may be used. Examples of the anhydrous liquid medium include linear hydrocarbons, such as pentane, hexane, heptane, or combinations thereof, or another simple liquid hydrocarbon. Anhydrous cyclic or aromatic hydrocarbons may also be used. Anhydrous liquid media may be particularly desirable because they are devoid of oxygen (i.e., do not contain any oxygen atoms). Other suitable liquid media may include fluorinated solvents or stable organic solvents whose oxygen atoms will not oxidize the metal starting materials.

The use of the liquid medium may also facilitate uniform mixing and alloying among the aluminum, iron and silicon during the formation of the alloy. The liquid medium may ensure that the desired phase is formed (as starting material is not lost throughout the process) and may also improve the yield of the desired phase.

The ratio of total starting materials to liquid media may range from 1:5 to 1:10 by volume.

The method disclosed herein forms stable $Al_xFe_ySi_z$ phase alloys, wherein x ranges from about 3 to about 5, y ranges from about 1.5 to about 2.2, and z is about 1. The resulting alloy predominantly has the desired stable phase(s), which provide exceptional high temperature properties with high oxidation resistance due, in part, to the high amount of aluminum. Moreover, quasi-equilibrium $Al_xFe_ySi_z$ ternary phases have exceptional stiffness and high temperature strength.

The qualities of the stable $Al_xFe_ySi_z$ phase alloys render them suitable for components of an automobile or other vehicle (e.g., motorcycles, boats). As examples, the stable $Al_xFe_ySi_z$ phase alloys may be suitable for forming lighter engine valves or other lightweight valves, for forming lightweight pistons, for forming rotating and reciprocating parts of an internal combustion engine, and/or for use in turbocharger applications (e.g., forming turbocharger wheels). The stable $Al_xFe_ySi_z$ phase alloys may also be used in a variety of other industries and applications, including, as non-limiting examples aerospace components, industrial equipment and machinery, farm equipment, and/or heavy machinery. Forming components from the stable $Al_xFe_ySi_z$ phase alloys disclosed herein may be accomplished using any suitable technique, such as rolling, forging, stamping, or casting (e.g., die casting, sand casting, permanent mold casting, etc.).

As used herein, the term high-strength means the alloy (or component formed therefrom) exhibits a tensile strength of greater than or equal to about 450 MPa. As examples, the tensile strength may be greater than or equal to about 500 MPa, greater than or equal to about 900 MPa, greater than or equal to about 1,300 MPa, or greater than or equal to about 1,600 MPa.

Also as used herein, the term lightweight means that the alloy forming the component has a density of less than or equal to about 5 g/cm$^3$. As an example, the density of the alloy may be 4.1 g/cm$^3$ or less.

The high-strength, lightweight alloy further exhibits high stiffness and good stability and strength at high or elevated temperatures. High or elevated temperatures may be considered to be those that are greater than or equal to 800° C. High strength at an elevated temperature (e.g., greater than or equal to 800° C.) may be considered to be greater than or equal to 400 MPa, greater than or equal to 500 MPa, greater than or equal to 600 MPa, greater than or equal to 700 MPa, greater than or equal to 800 MPa, and in certain variations, greater than or equal to about 900 MPa. High stiffness at an elevated temperature (e.g., greater than or equal to 800° C.) may be considered to be a Young's modulus of greater than or equal to 110 GPa; greater than or equal to 120 GPa; greater than or equal to 130 GPa; greater than or equal to 140 GPa; greater than or equal to 150 GPa; and in certain variations, greater than or equal to 160 GPa. As examples, the Young's modulus for the $Al_4Fe_{1.7}Si$ and $Al_3Fe_2Si$ phases ranges from about 230 GPa to about 280 GPa.

To further illustrate the present disclosure, an example is given herein. It is to be understood that this example is provided for illustrative purposes and is not to be construed as limiting the scope of the present disclosure.

EXAMPLE

Ball milling was used to form 1 gram of $Al_4Fe_{1.7}Si$, 3 grams of $Al_4Fe_{1.7}Si$, and 3 grams of $Al_3Fe_2Si$.

The starting materials were 99.5% pure aluminum powder from Alfa Aesar (Stock #11067, Lot# A26127), 97% pure iron powder from J.T. Baker (Lot M47600), and 99.5% pure silicon powder from Alfa Aesar (Stock#12681, Lot# G08H24).

The starting materials for the 1 gram sample of $Al_4Fe_{1.7}Si$ are shown in Table 1.

TABLE 1

| Element | Targeted Weight % | Targeted Weight (g) | Actual Weight (g) |
|---|---|---|---|
| Al | 46.73 | 0.4673 | 0.4679 |
| Fe | 41.10 | 0.4110 | 0.4106 |
| Si | 12.17 | 0.1217 | 0.1221 |

The starting materials for the 3 gram sample of $Al_4Fe_{1.7}Si$ are shown in Table 2.

TABLE 2

| Element | Targeted Weight % | Targeted Weight (g) | Actual Weight (g) |
|---|---|---|---|
| Al | 46.73 | 1.4019 | 1.4010 |
| Fe | 41.10 | 1.2330 | 1.2335 |
| Si | 12.17 | 0.3651 | 0.3652 |

The starting materials for the 3 gram sample of $Al_3Fe_2Si$ are shown in Table 3.

TABLE 3

| Element | Targeted Weight % | Targeted Weight (g) | Actual Weight (g) |
|---|---|---|---|
| Al | 36.68 | 1.1004 | 1.1007 |
| Fe | 50.57 | 1.5171 | 1.5176 |
| Si | 12.75 | 0.3825 | 0.3830 |

The 1 gram and 3 gram samples were weighed out, and the starting materials for each of the samples were introduced into respective ball milling jars.

Pentane (available from VWR International) was added to the respective ball milling jars and was used during ball milling of the 3 gram samples. The pentane was used to avoid sticking of the starting materials and to achieve better mixing of the starting materials. Pentane was not used for the 1 gram sample. While the results (see FIGS. 1A and 2) illustrate that the alloy may be formed without the liquid medium, it is to be understood that the liquid medium may be used.

The grinding/milling media, which included 3 balls (two small balls, each with a diameter of 6.20 mm, and one large ball with a diameter of 12.65 mm), were added to the respective ball milling jars.

Argon gas was used when the pentane and the milling media, or the milling media without pentane, were added to the jars.

Ball milling was then performed using the SPEX SamplePrep 8000M MIXER/MILL®. For the 1 gram sample, milling was accomplished for about 16 hours. For the 3 gram samples, milling was accomplished for about 32 hours.

Figure 1B:
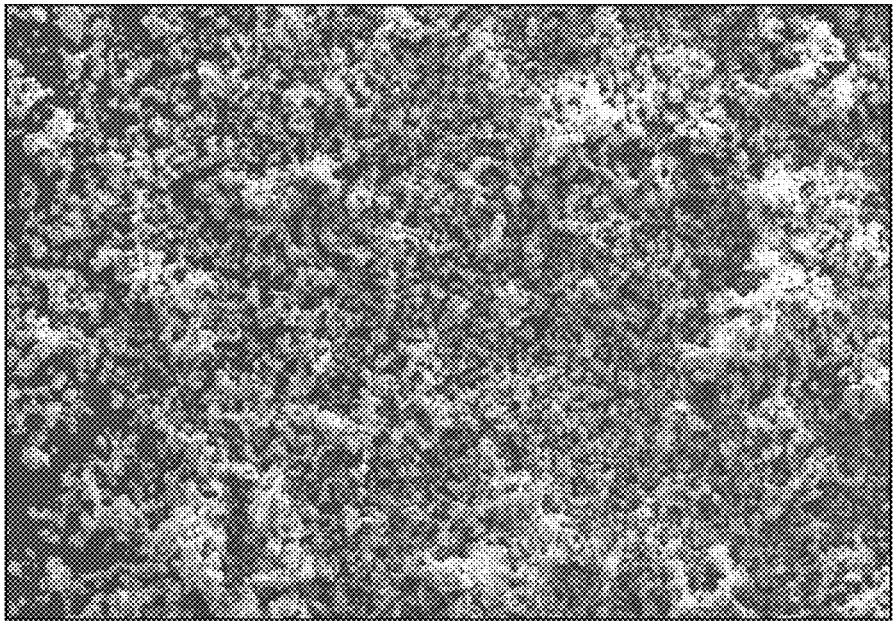
Figure 4:
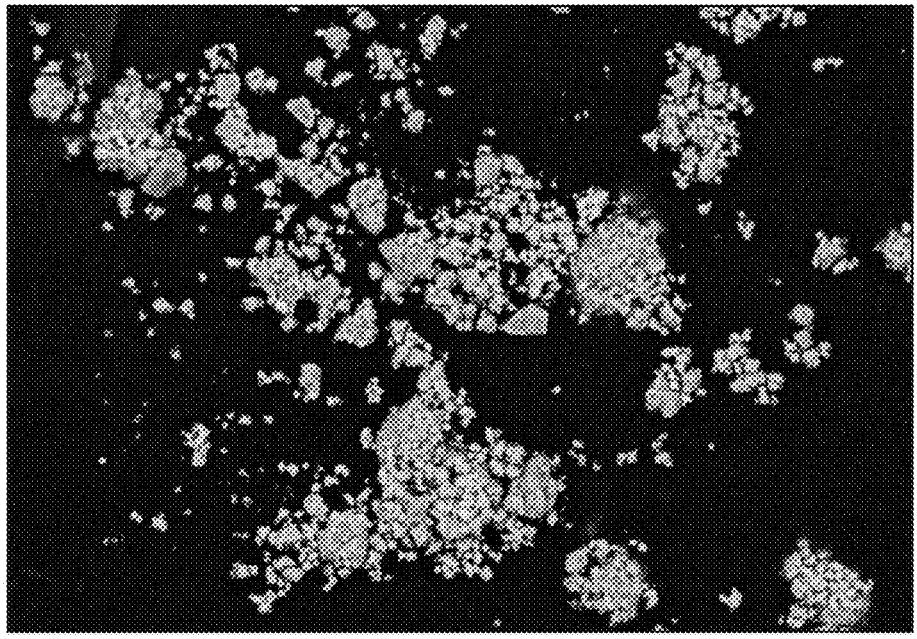
FIG. 4 is a SEM image of a 3 gram sample of $Al_3Fe_2Si$ formed via an example of the method disclosed herein.

After milling, the product from the 1 gram sample and the 3 gram samples were removed from the respective jars. Scanning electron microscope images were taken of each of the products. FIG. 1A shows the 1 gram sample product of $Al_4Fe_{1.7}Si$, FIG. 1B shows the 3 gram sample product of $Al_4Fe_{1.7}Si$, and FIG. 4 shows the 3 gram sample product of $Al_3Fe_2Si$. As depicted, the 3 gram sample products, which were formed in the presence of pentane, were more uniform powders with a smaller particle size than the 1 gram sample product.

Figure 2:
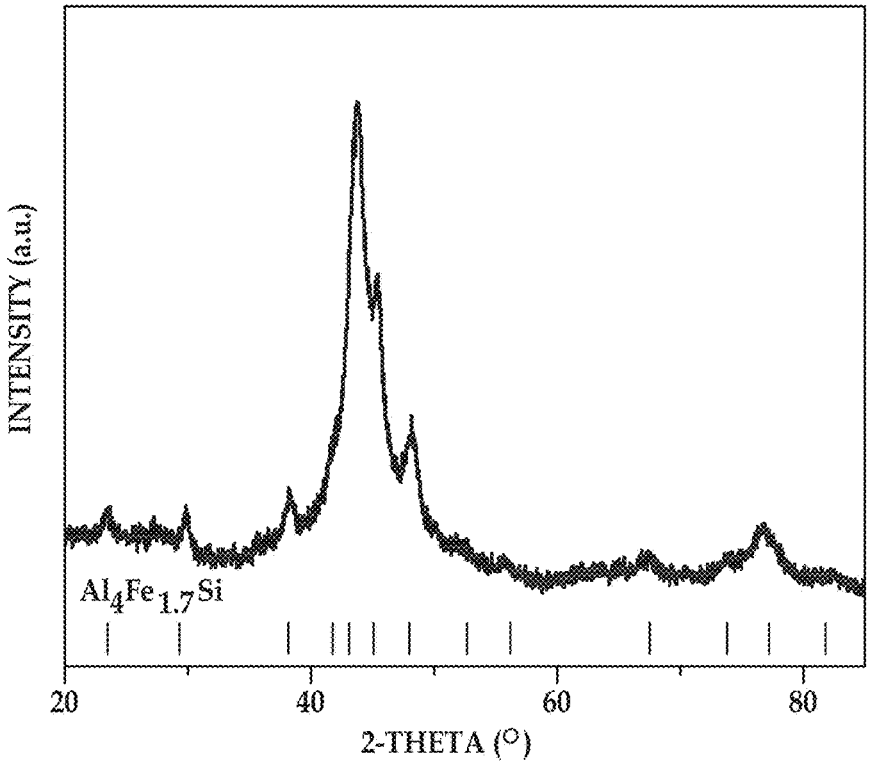
FIG. 2 is an X-ray diffraction (XRD) spectrum for the 1 gram sample of $Al_4Fe_{1.7}Si$.
Figure 3:
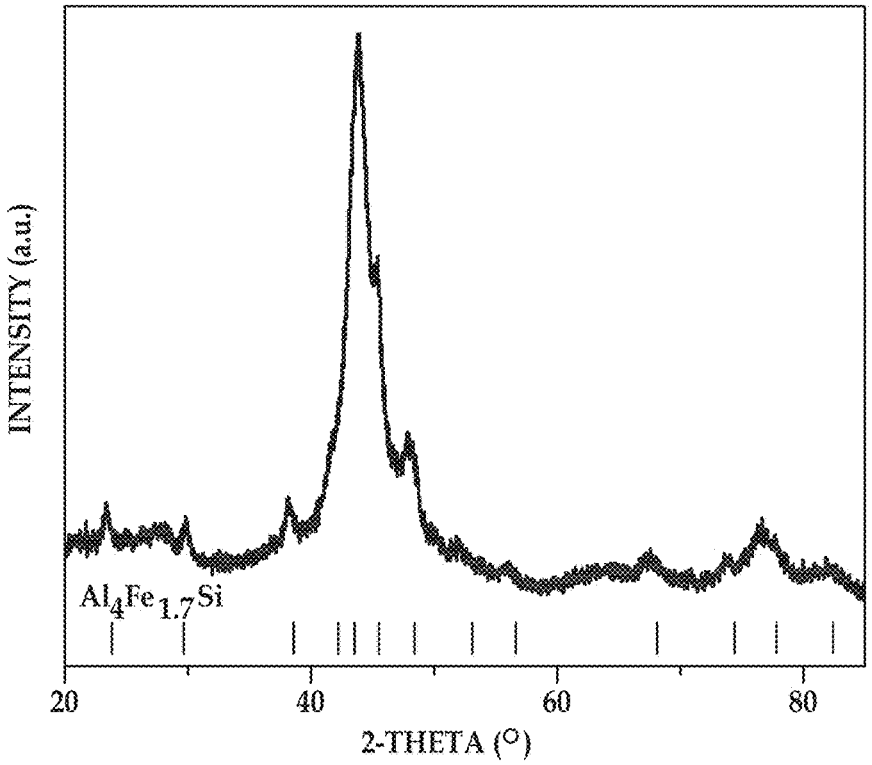
FIG. 3 is an XRD spectrum for the 3 gram sample of $Al_4Fe_{1.7}Si$.
Figure 5:
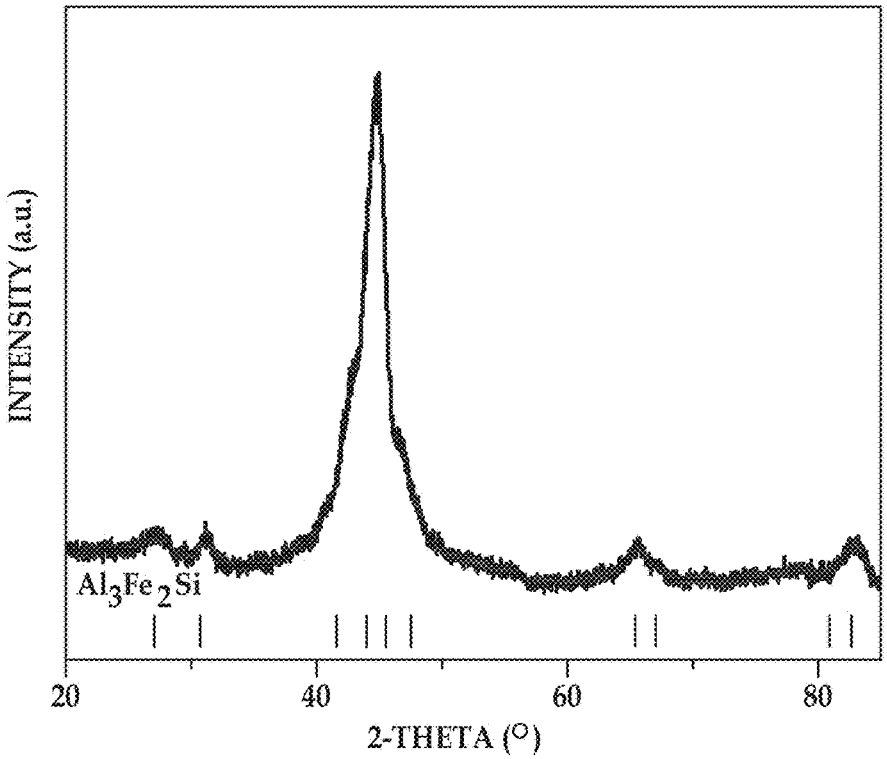
FIG. 5 is an XRD spectrum for the 3 gram sample of $Al_3Fe_2Si$.

FIGS. 2 and 3 respectively show the XRD phase identification results of the 1 gram and 3 gram sample of the $Al_4Fe_{1.7}Si$. X-ray diffraction was performed using a Bruker D8 Advance X-Ray diffraction system and a Rigaku X-ray Diffraction system. The raw data from each system matched the reference data for $Al_4Fe_{1.7}Si$ hexagonal phase (represented by the vertical lines that are labeled $Al_4Fe_{1.7}Si$). FIG. 5 shows the XRD phase identification results from the 3 gram sample of the $Al_3Fe_2Si$. X-ray diffraction was performed using a Bruker D8 Advance X-Ray diffraction system and a Rigaku X-ray Diffraction system. The raw data from each system matched the $Al_3Fe_2$ Si reference data (represented by the vertical lines that are labeled $Al_3Fe_2Si$). Clearly, each of the sample products was formed of the desired $Al_4Fe_{1.7}Si$ or $Al_3Fe_2Si$ phases.

It is to be understood that the ranges provided herein include the stated range and any value or sub-range within the stated range. For example, a range from about 9 wt % to about 13 wt % should be interpreted to include not only the explicitly recited limits of about 9 wt % to about 13 wt %, but also to include individual values, such as 9.25 wt %, 12.3 wt %, etc., and sub-ranges, such as from about 9.5 wt % to about 10.5 wt %, etc. Furthermore, when "about" is utilized to describe a value, this is meant to encompass minor variations (up to +/−10%) from the stated value.

Reference throughout the specification to "one example", "another example", "an example", and so forth, means that a particular element (e.g., feature, structure, and/or characteristic) described in connection with the example is included in at least one example described herein, and may or may not be present in other examples. In addition, it is to be understood that the described elements for any example may be combined in any suitable manner in the various examples unless the context clearly dictates otherwise.

In describing and claiming the examples disclosed herein, the singular forms "a", "an", and "the" include plural referents unless the context clearly dictates otherwise While several examples have been described in detail, it is to be understood that the disclosed examples may be modified. Therefore, the foregoing description is to be considered non-limiting.

What is claimed is:

1. A method for forming a high-strength, lightweight alloy, comprising:

ball milling starting materials including aluminum, iron, and silicon, to generate the high-strength, lightweight alloy of a stable $Al_xFe_ySi_z$ phase, wherein x ranges from about 3 to about 5, y ranges from about 1.5 to about 2.2, and z is about 1.

2. The method as defined in claim 1, further comprising performing the ball milling in the presence of an anhydrous liquid medium.

3. The method as defined in claim 2 wherein a ratio of total starting materials to the anhydrous liquid medium ranges from 1:5 to 1:10 by volume.

4. The method as defined in claim 2 wherein the anhydrous liquid medium is an anhydrous hydrocarbon.

5. The method as defined in claim 4 wherein the anhydrous hydrocarbon is selected from the group consisting of pentane, hexane, heptane, and combinations thereof.

6. The method as defined in claim 1 wherein the stable $Al_xFe_ySi_z$ phase has x equal to 3, y equal to 2, and z equal to 1, and wherein the starting materials include:

from about 36 wt % to about 37 wt % aluminum based on a total wt % of the starting materials;

from about 50 wt % to about 51 wt % iron based on the total wt % of the starting materials;

and from about 12 wt % to about 13 wt % silicon based on the total wt % of the starting materials.

7. The method as defined in claim 1 wherein the stable $Al_xFe_ySi_z$ phase has x ranging from 4 to 5, y ranges from about 1.5 to about 2.2, and z equal to 1, and wherein the starting materials include:

from about 41 wt % to about 55 wt % aluminum based on a total wt % of the starting materials;

from about 33 wt % to about 48 wt % iron based on the total wt % of the starting materials; and from about 9 wt % to about 13 wt % silicon based on the total wt % of the starting materials.

8. The method as defined in claim 1 wherein the starting materials include:

an aluminum powder that is at least 99% pure;

an iron powder that is at least 97% pure; and a silicon powder that is at least 99% pure.

9. The method as defined in claim 1, further comprising performing the ball milling for a time period ranging from about 8 hours to about 32 hours.

10. The method as defined in claim 1 wherein the ball milling of the starting materials is accomplished in a high energy ball mill.

11. The method as defined in claim 1 wherein the ball milling of the starting materials is accomplished with:

at least one large ball having a diameter ranging from about 10 mm to about 13 mm; and at least two small balls having a diameter ranging from about 3 mm to about 7 mm.

12. The method as defined in claim 11 wherein a ratio of the large ball to the small balls is 1:2.

13. The method as defined in claim 1 wherein the ball milling of the starting materials is accomplished in an environment containing an inert gas.

14. The method as defined in claim 1, further comprising forming a vehicle component from the high-strength, lightweight alloy.

15. A high-strength, lightweight alloy formed by the process of claim 1, the high-strength, lightweight alloy including the stable $Al_xFe_ySi_z$ phase, wherein x ranges from about 3 to about 5, y ranges from about 1.5 to about 2.2, and z is about 1.

16. The high-strength, lightweight alloy as defined in claim 15 wherein the stable $Al_xFe_ySi_z$ phase is $Al_4Fe_{1.7}Si$ or $Al_3Fe_2Si$, and wherein a Young's modulus of the alloy ranges from about 230 GPa to about 280 GPa.

17. A method for facilitating uniform mixing and alloying during formation of a high-strength, lightweight alloy, the method comprising:

adding starting materials and a grinding medium to a ball mill, the starting materials including aluminum, iron, and silicon;

adding an anhydrous liquid medium to the ball mill with the starting materials and the grinding medium; and ball milling the starting materials in the presence of the grinding medium and the anhydrous liquid medium to generate the high-strength, lightweight alloy of a stable $Al_xFe_ySi_z$ phase, wherein x ranges from about 3 to about 5, y ranges from about 1.5 to about 2.2, and z is about 1.

18. The method as defined in claim 17 wherein a ratio of total starting materials to the anhydrous liquid medium ranges from 1:5 to 1:10 by volume.

19. The method as defined in claim 17 wherein the anhydrous liquid medium is a hydrocarbon selected from the group consisting of pentane, hexane, heptane, and combinations thereof.

20. The method as defined in claim 17 wherein one of:

the stable $Al_xFe_ySi_z$ phase has x equal to 3, y equal to 2, and z equal to 1, and adding starting materials includes:

adding from about 36 wt % to about 37 wt % of aluminum based on a total wt % of the starting materials;

adding from about 50 wt % to about 51 wt % of iron based on the total wt % of the starting materials; and adding from about 12 wt % to about 13 wt % of silicon based on the total wt % of the starting materials; or the stable $Al_xFe_ySi_z$ phase has x ranging from 4 to 5, y ranges from about 1.5 to about 2.2, and z equal to 1, and adding the starting materials includes:

adding from about 41 wt % to about 55 wt % of aluminum based on a total wt % of the starting materials;

adding from about 33 wt % to about 48 wt % of iron based on the total wt % of the starting materials; and adding from about 9 wt % to about 13 wt % of silicon based on the total wt % of the starting materials.

* * * * *